United States Patent [19]

Reece

[11] Patent Number: 5,011,107

[45] Date of Patent: Apr. 30, 1991

[54] POST ANCHOR APPARATUS

[76] Inventor: Roger R. Reece, 9415 E. 500 S., Upland, Ind. 46989

[21] Appl. No.: 493,850

[22] Filed: Mar. 15, 1990

[51] Int. Cl.[5] ..... F16M 13/00

[52] U.S. Cl. ..... 248/545; 52/157; 248/156; 256/1; 256/DIG. 5

[58] Field of Search ..... 248/545, 156, 508, 530; 52/157, 165; 256/DIG. 5, 1; 81/124.3, 124.7

[56] References Cited

U.S. PATENT DOCUMENTS

| | | | |
|---|---|---|---|
| 818,672 | 4/1906 | Eck et al. | 256/DIG. 5 |
| 2,270,325 | 1/1942 | Matthews | 248/545 X |
| 2,777,454 | 1/1957 | Kramer | 248/156 X |
| 2,780,869 | 2/1957 | Long | 248/156 X |
| 3,286,962 | 11/1966 | Warth | 248/156 X |
| 3,865,309 | 2/1975 | Greenhalgh | 256/1 X |
| 4,593,872 | 6/1986 | Svensson | 52/157 X |
| 4,644,713 | 2/1987 | Lehman | 52/165 |
| 4,702,047 | 10/1987 | Stokes | 52/157 X |
| 4,863,137 | 9/1989 | Cockman et al. | 52/157 X |
| 4,923,165 | 5/1990 | Cockman | 52/157 X |

FOREIGN PATENT DOCUMENTS

| | | | |
|---|---|---|---|
| 8300796 | 10/1984 | Netherlands | 52/157 |
| 0596694 | 3/1978 | U.S.S.R. | 52/157 |

OTHER PUBLICATIONS

PCT WO84/04774–Published Date, Dec. 6, 1984, in Sweden.

*Primary Examiner*—Ramon O. Ramirez
*Attorney, Agent, or Firm*—Leon Gilden

[57] ABSTRACT

An apparatus including a rigid shaft and terminating at a lower pointed end, with a mounting head integrally formed and aligned with an upper terminal end of the shaft. The mounting head includes a plurality of spaced parallel plates formed with apertures therethrough to receive fasteners to be directed within a post mounted within the head. The shaft includes a helical web integrally mounted to the shaft adjacent the lower terminal end, and optionally includes a second helical web mounted to the shaft spaced between the mounting head and the first helical web to direct soil upwardly of the shaft interiorly of a ground support surface.

1 Claim, 4 Drawing Sheets

PRIOR ART

POST ANCHOR APPARATUS

BACKGROUND OF THE INVENTION

1. Field of the Invention

The field of invention relates to post anchor apparatus, and more particularly pertains to a new and improved post anchor apparatus wherein the same is threadedly directed into the ground support surface for assisting in the anchoring of a post into the ground surface.

2. Description of the Prior Art

The anchoring and securement of posts within the ground surface they are secured within is frequently required due to loads encountered by fence structure. Particularly in geographical locations where ground frost develops to an appreciable extent, a prior practice of requiring a hole to be dug below a frost level requires an expensive use of labor and material. The instant invention attempts to overcome deficiencies of the prior art by permitting the digging of a relatively shallow hole for receiving an associated fence post utilizing an anchor member that threadedly directs an anchor apparatus below frost level in association with the post. Examples of the prior art include U.S. Pat. No. 819,729 to Cleven wherein an anchor structure includes a generally "U" shaped member, wherein upper ends of the member are secured to lower terminal ends of the post to assist in securing the post within the ground.

U.S. Pat. No. 4,801,123 to Taylor sets forth a ground support system for posts wherein regularly configured conical base members are directed interiorly of the ground to secure posts mounted to the base members.

U.S. Pat. No. 3,917,231 to Fink provides the use of a traffic barrier, wherein a plate base includes an upwardly extending socket to receive a post therewithin.

U.S. Pat. No. 3,195,845 to Conti illustrates the use of a socket connection for securing various posts within other relative framework components of the organization.

U.S. Pat. No. 3,057,601 to Simpson sets forth a portable highway barricade illustrating a manner of securing various structural elements of the barricade within other related support beams to provide an integral barricade construction.

As such, it may be appreciated that there continues to be a need for a new and improved post anchor apparatus wherein the same addresses both the problems of ease of use, as well as effectiveness in construction in directing and securing a post within the ground and in this respect, the present invention substantially fulfills this need.

SUMMARY OF THE INVENTION

In view of the foregoing disadvantages inherent in the known types of post anchor apparatus now present in the prior art, the present invention provides a post anchor apparatus wherein the same permits threadedly directing a post within the ground to firmly anchor the post therewithin. As such, the general purpose of the present invention, which will be described subsequently in greater detail, is to provide a new and improved post anchor apparatus which has all the advantages of the prior art post anchor apparatus and none of the disadvantages.

To attain this, the present invention provides an apparatus including a rigid shaft and terminating at a lower pointed end, with a mounting head integrally formed and aligned with an upper terminal end of the shaft. The mounting head includes a plurality of spaced parallel plates formed with apertures therethrough to receive fasteners to be directed within a post mounted within the head. The shaft includes a helical web integrally mounted to the shaft adjacent the lower terminal end, and optionally includes a second helical web mounted to the shaft spaced between the mounting head and the first helical web to direct soil upwardly of the shaft interiorly of a ground support surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follow may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved post anchor apparatus which has all the advantages of the prior art post anchor apparatus and none of the disadvantages.

It is another object of the present invention to provide a new and improved post anchor apparatus which may be easily and efficiently manufactured and marketed.

It is a further object of the present invention to provide a new and improved post anchor apparatus which is of a durable and reliable construction.

An even further object of the present invention is to provide a new and improved post anchor apparatus which is susceptible of a low cost of manufacture with regard to both materials and labor, and which accordingly is then susceptible of low prices of sale to the consuming public, thereby making such post anchor apparatus economically available to the buying public.

Still yet another object of the present invention is to provide a new and improved post anchor apparatus which provides in the apparatuses and methods of the prior art some of the advantages thereof, while simultaneously overcoming some of the disadvantages normally associated therewith.

Still another object of the present invention is to provide a new and improved post anchor apparatus wherein the same fixedly secures the lower terminal end of an associated post thereto and permits threadedly directing the associated post within the ground to direct the post below frost level considerations within a ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 to 8 thereof, a new and improved post anchor apparatus embodying the principles and concepts of the present invention and generally designated by the reference numbers 10 and 10*a* will be described.

Figure 1:
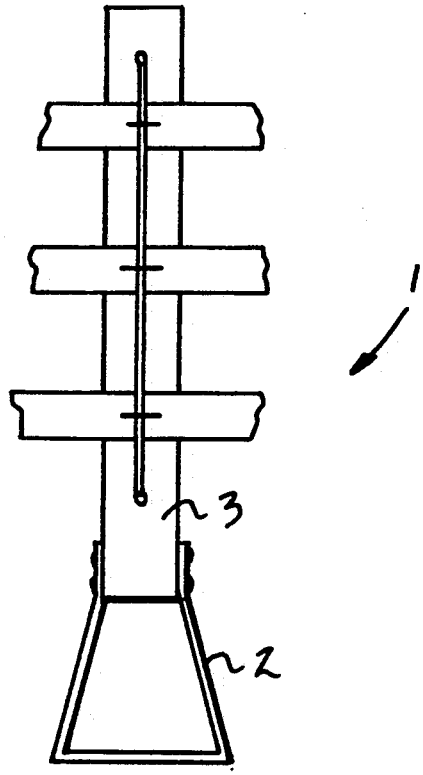
FIG. 1 is an orthographic side view, taken in elevation, of a prior art post anchor apparatus.
Figure 2:
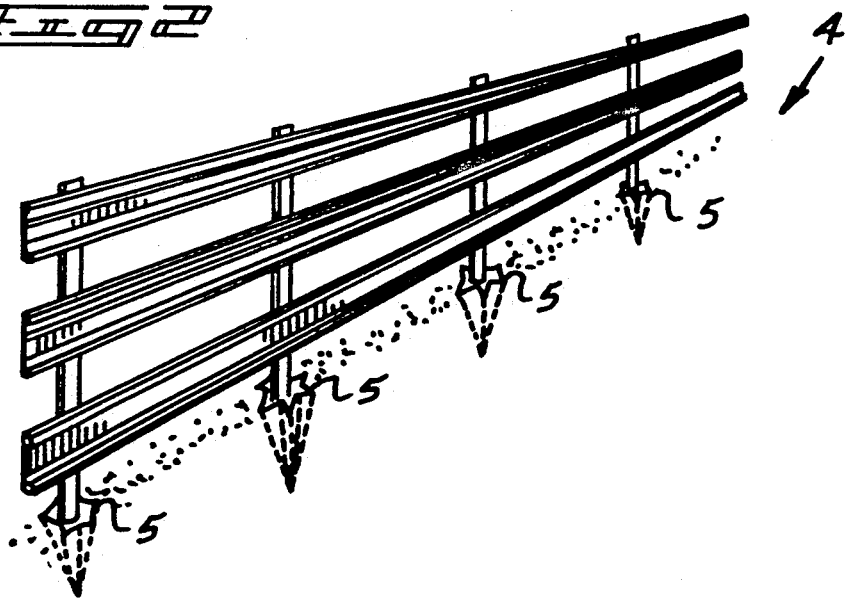
PRIOR ART Fig 2
FIG. 2 is an isometric illustration of a yet further example of a prior art post anchor apparatus.
Figure 3:
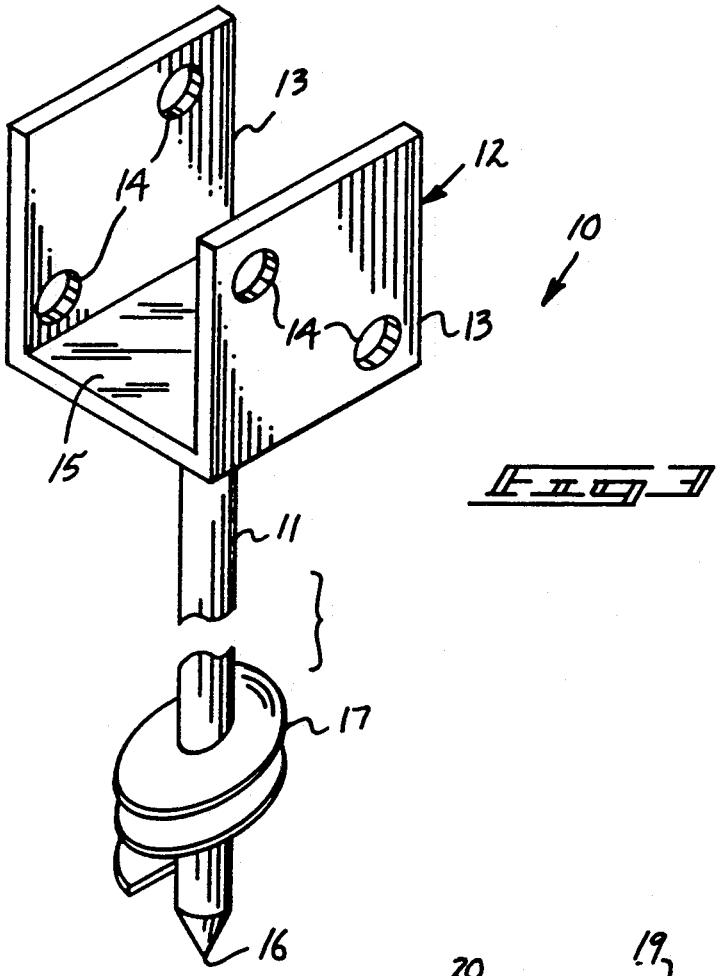
FIG. 3 is an isometric illustration of the instant invention.

FIG. 1 illustrates a prior art post anchor apparatus 1, wherein a generally "U" shaped member 2 mounts a post 3 at upper terminal ends of the legs of the "U" shaped flange to assist in anchoring the post 3 within underlying ground. FIG. 2 illustrates a further prior art post anchor apparatus 4, wherein the fence posts of the associated fence are mounted within the irregularly configured conical anchor members 5 to assist in securing the posts within the ground.

Figure 5:
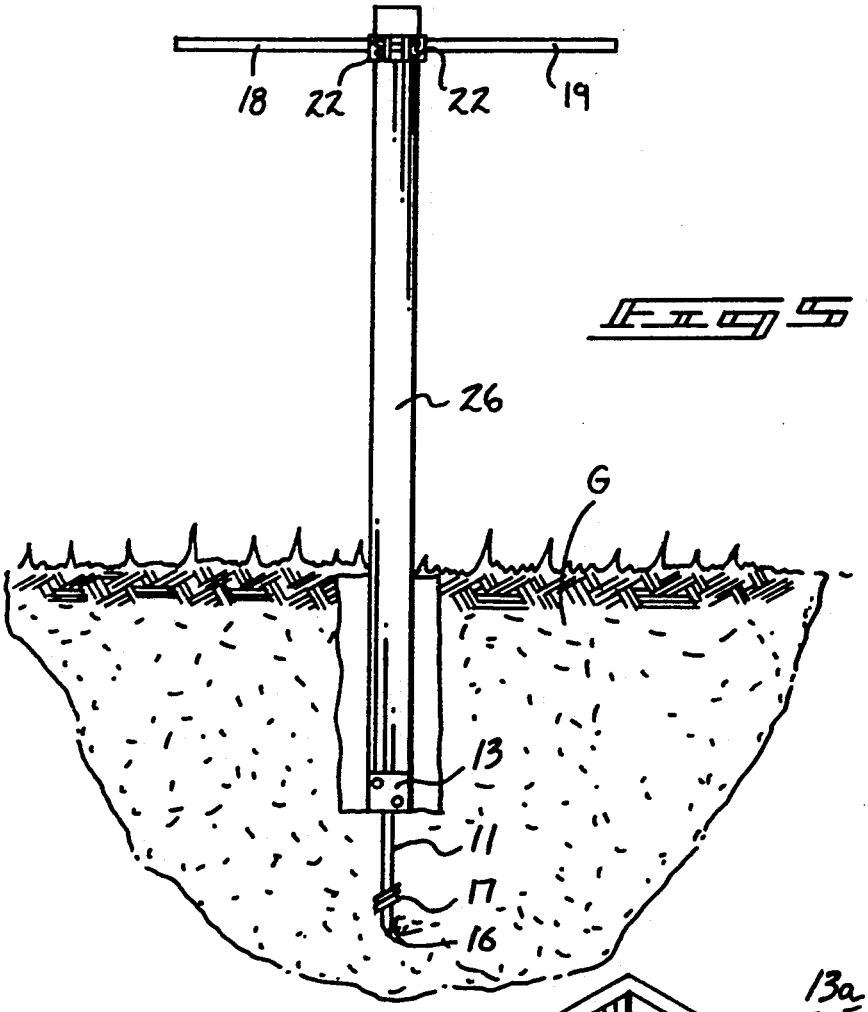
FIG. 5 is an orthographic side view, taken in elevation, of the instant invention illustrating a post in association therewith.

More specifically, the post anchor apparatus 10 of the instant invention essentially comprises an elongate, rigid support shaft 11 of a generally cylindrical configuration, including a lower, pointed terminal end 16. The shaft 16 includes a helical web 17 defined by a predetermined pitch, whereupon rotation of the shaft 11 directs the shaft interiorly of the ground "G" to which the post is to be mounted, as illustrated in FIG. 5 for example.

A mounting head 12 is integrally and coaxially aligned onto an upper terminal end of the shaft 11. The mounting head 12 includes spaced parallel rigid webs 13 formed with through-extending apertures 14 directed therethrough, and orthogonally mounted to a floor plate 15 that in turn is integrally and orthogonally secured to the upper terminal end of the shaft 11. The apertures 14 receive fasteners, such as nails and the like, to be directed therethrough for securing the associated post 26 to the plates 13, as illustrated in FIG. 5.

Figure 4:
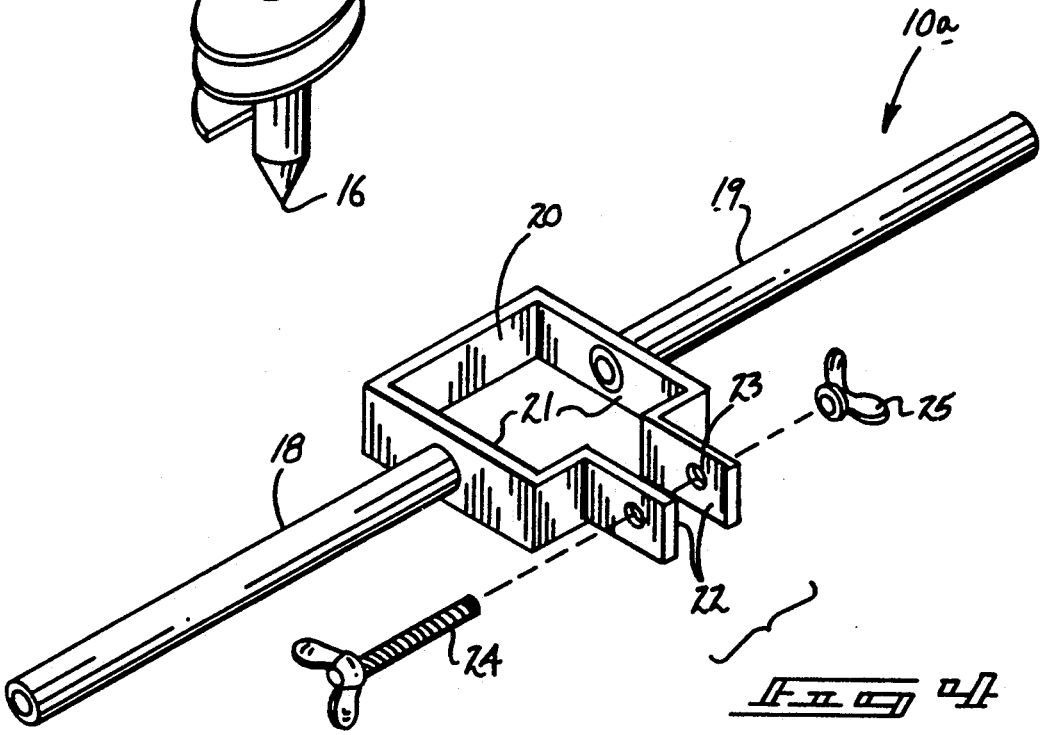
FIG. 4 is an isometric illustration of a removable clamp and torquing member utilized by the instant invention.

FIG. 4 illustrates the use of a torque member 10*a* for temporary securement about the post 26, wherein the torque member 10*a* includes spaced and coaxially aligned first and second handles 18 and 19 orthogonally and integrally mounted to spaced parallel side wall plates 21. The side wall plates 21 are orthogonally and integrally mounted at their rear ends to a rear plate 20 and forward "L" shaped plates 22 are integrally mounted to forward terminal ends of the side wall plates, as illustrated in FIG. 4. The "L" shaped plates 22 include adjacent forward legs, with coaxially aligned plate apertures 23 directed therethrough to receive a threaded shaft 24 through the apertures, with a fastener 25 threadedly mounted to the shaft to direct the "L" shaped plates towards one another and accordingly clamp a post 26 within the framework defined by the side wall, rear, and forward plates.

In use, a hole is dug within the ground "G" to at least a position relatively aligned with the frost level of a surrounding geographical area, wherein the mounting head 12 is thereafter secured to the lower terminal end of the post 26. Subsequently, post 26 is positioned at the lower terminal end of the hole and rotated by use of the torque member to direct the post into the associated hole.

Figure 6:
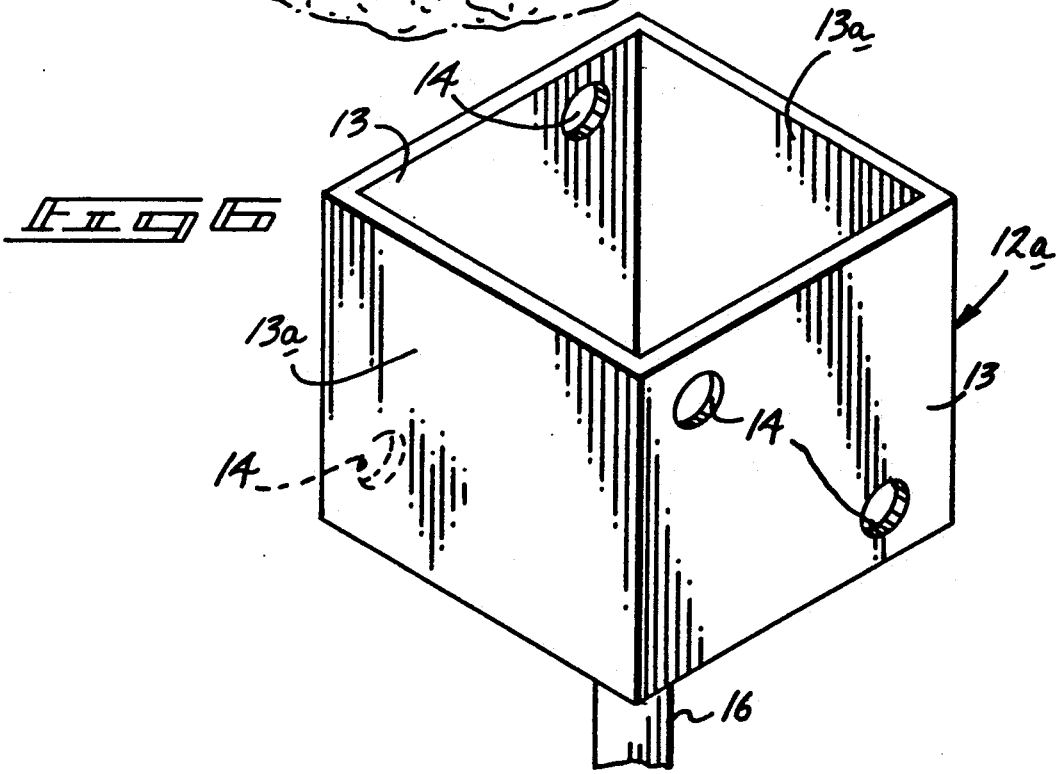
FIG. 6 is an isometric illustration of a modified mounting head utilized by the instant invention.

FIG. 6 illustrates the use of a modified mounting head 12*a*, wherein in addition to the spaced parallel webs 13, second spaced parallel webs 13*a* are utilized to enhance a geometric integrity of the organization.

Figure 7:
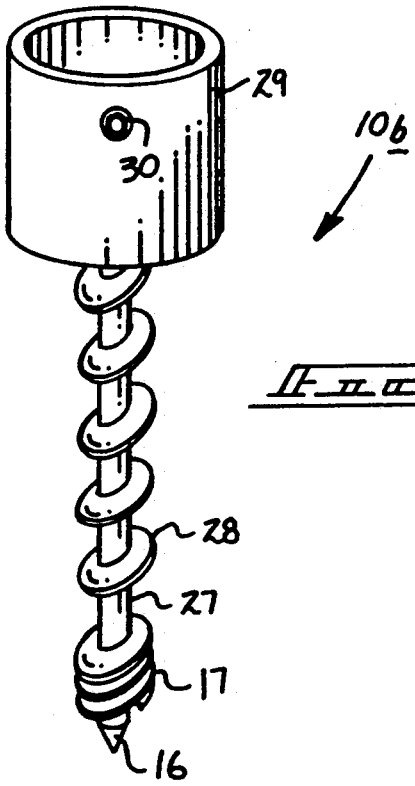
FIG. 7 is an isometric illustration of a further modified post anchor apparatus utilized by the instant invention.

FIG. 7 illustrates the use of a modified support shaft 27 wherein in addition to the helical web 17, a second helical web 28 is utilized spaced above the first helical web 17 and below an associated mounting head. The second helical web is of a greater pitch than the first or primary helical web 17 to assist in enhanced removal of soil upwardly from a hold dug by the first helical web 17 and directs such soil upwardly to assist in ease of directing the modified shaft 27 within the ground surface "G". FIG. 7 also illustrates the use of a circular mounting head 29 utilizing a set screw 30 in cases where a cylindrical post is utilized.

Figure 8:
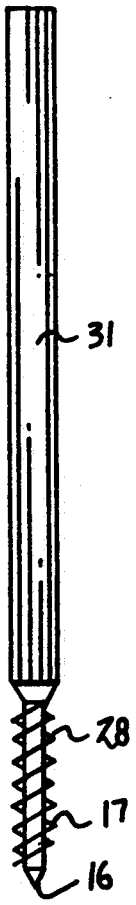
FIG. 8 is an orthographic side view, taken in elevation, of an integral post and helical shaft structure utilized by the instant invention.

FIG. 8 illustrates an integral post 31 mounting integrally the modified shaft including a lower terminal end 16 and the first and second helical webs 17 and 28, in a manner as described per the embodiment of FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A post anchor apparatus comprising, a rigid, elongate cylindrical support shaft including a lower terminal end and an upper terminal end, the upper terminal end including a mounting head integrally secured to the upper terminal end, the mounting head configured for reception of a lower terminal end of a fence post therewithin, and first helical web integrally mounted about the post shaft adjacent the lower terminal end, and wherein the lower terminal end is pointed, and wherein the mounting head includes a rigid planar floor, the rigid planar floor integrally and orthogonally mounted to the upper terminal end of the support shaft, and the floor including spaced parallel webs integrally and orthogonally mounted to opposed sides of the floor, with the webs including a plurality of apertures therethrough for receiving fasteners to secure the webs to the lower terminal ends of the fence post, and wherein the mounting head further includes further webs integrally mounted to the floor to define an enclosed socket to receive the lower terminal end of the fence post, and further including a further helical web integrally formed about the support shaft formed between the helical web and the mounting head, and the further helical web defined by a predetermined pitch, and the helical web defined by a first pitch, wherein the predetermined pitch is greater than the first pitch, and further including a torque member, the torque member including spaced, coaxially aligned handles, the handles integrally and orthogonally mounted to spaced side walls, the side walls integrally and orthogonally mounted to a rear plate, and the side walls integrally and orthogonally mounted to "L" shaped brackets at their forward terminal ends, the "L" shaped brackets including an aperture formed through each "L" shaped bracket, wherein the aperture of each "L" shaped bracket is aligned relative to one another, and a threaded member received through the apertures, and a fastener securable to the threaded member to clamp the "L" shaped brackets together, and clampingly enclose the post within the member to effect rotation of the post to secure the post within the support surface.

* * * * *